US005614347A

United States Patent [19]

Aoki et al.

[11] Patent Number: 5,614,347

[45] Date of Patent: Mar. 25, 1997

[54] TONER FOR DEVELOPING LATENT ELECTROSTATIC IMAGES

[75] Inventors: Mitsuo Aoki; Tetsuo Isoda, both of Numazu; Masanori Suzuki, Shizuoka-ken; Yoshihiro Suguro, Numazu, all of Japan

[73] Assignee: Ricoh Company, Ltd., Tokyo, Japan

[21] Appl. No.: 597,413

[22] Filed: Feb. 8, 1996

[30] Foreign Application Priority Data

Feb. 8, 1995 [JP] Japan ..... 7-020732
Jan. 22, 1996 [JP] Japan ..... 8-008774

[51] Int. Cl.[6] ..... G03G 9/087
[52] U.S. Cl. ..... 430/109; 430/111
[58] Field of Search ..... 430/109, 111

[56] References Cited

U.S. PATENT DOCUMENTS 5,324,611 6/1994 Fuller et al. ..... 430/109

FOREIGN PATENT DOCUMENTS 4-257868 9/1992 Japan ..... 430/109

OTHER PUBLICATIONS

Japanese Industrial Standard Petroleum Waxes, JIS K 2235–1991, (pp. 1–26), Edition 1.

*Primary Examiner*—Roland Martin
*Attorney, Agent, or Firm*—Oblon, Spivak, McClelland, Maier & Neustadt, P.C.

[57] ABSTRACT

A toner for developing latent electrostatic images including a resin component, with the image fixing temperature of the toner being in the range of 100° to 140° C., and the penetration of the toner, measured when allowed to stand at 60° C. for 4 hours in accordance with Japanese Industrial Standards (JIS) K 2235, being 5 mm or more. The resin component for the toner may include a hydrogenated petroleum resin with a hydrogenation ratio of 50% or more, and optionally polyester resin.

4 Claims, No Drawings

TONER FOR DEVELOPING LATENT ELECTROSTATIC IMAGES

BACKGROUND OF THE INVENTION

1. Field of the Invention

The present invention relates to a toner for developing latent electrostatic images formed by electrophotography, electrostatic recording method, or electrostatic printing method, to visible toner images.

2. Discussion of Background

Various image recording methods by electrophotography or the like are described, for instance, in U.S. Pat. No. 2,297,691, Japanese Patent Publications No. 49-23910 and No. 43-24748. Generally in such recording methods, latent electrostatic images are formed on a photoconductor comprising a photoconductive material and then developed with a toner to visible toner images. When necessary, the developed toner images are transferred to a transfer sheet made of, for example, paper, and fixed thereon by the application thereto of heat and/or pressure, or a vapor of a solvent, whereby image-bearing copies are made.

The methods of developing such latent electrostatic images to visible toner images can be roughly classified into two methods.

One method is a liquid development method which uses a liquid developer comprising various kinds of finely-divided pigments or dyes dispersed in an insulating organic solvent.

The other method is a dry development method which uses a dry toner comprising a coloring agent, such as carbon black, dispersed in a natural or synthetic resin. Specific examples of the dry development method include cascade development, magnetic brush development and powder cloud development.

For fixing toner images on the transfer sheet, a heat roller image fixing method is in general use because of its excellent energy efficiency.

Image fixing by the heat roller image fixing method is conventionally performed by applying heat to toner images at a temperature of 150° to 200° C. for about 0.01 to 0.03 seconds. However, because of the necessity for the reduction of the required thermal energy for image fixing to low energy and for high speed copying, there is a keen demand for a toner which is capable of performing low temperature and quick image fixing.

The trend of reducing the thermal energy for image fixing will further continue.

Generally, toners for such low-energy image fixing have been improved by replacing a resin component in conventional toner with a resin having a low softening point or wax. However, such a low-temperature-fixing toner, however, has the shortcoming that the thermal preservability thereof is so poor that the toner is aggregated outside an image fixing portion by the heat applied thereto which is built up in the mechanical parts of a development unit in contact with the toner, or by some heat applied during the storage of the toner. Such aggregation of the toner is referred to as "blocking phenomenon".

In order to solve this problem, it has been tried to use, as a binder resin for toner, polyester resin which is considered to be suitable for the low-temperature image fixing and to have relatively good thermal preservability. However, there has not been available a toner which has satisfactory low-temperature image fixing performance and thermal preservability for use in practice at the same time. Polyester resin has the shortcoming that when polyester resin is used in the toner, the productivity thereof is considerably reduced in the course of a pulverizing process in the production of the toner because of the high strength of the polyester resin itself.

Japanese Laid-Open Patent Applications Nos. 50-99740, 50-99741, 50-99742, 53-118050 and 54-48556 describe that toners having both the low-temperature image fixing performance, for instance, with an image fixing temperature of 100° to 140° C., and the thermal preservability, can be prepared by use of a petroleum resin as a resin component for the toners.

However, in view of the recent demand for a toner with a further lower temperature image fixing temperature, there has not yet been developed a toner which completely satisfies such demand by mere use of any of conventional petroleum resins as a resin component for the toner.

SUMMARY OF THE INVENTION

It is therefore an object of the present invention to provide a toner for developing latent electrostatic images, which has both excellent low-temperature image fixing performance and satisfactory thermal preservability, and also has excellent pulverizing performance, and from which the previously mentioned problems of the conventional toners have been eliminated.

This object of the present invention can be achieved by a toner for developing latent electrostatic images, which comprises a resin component, with the image fixing temperature of the toner being in the range of 100° to 140° C., and the penetration of the toner, measured when allowed to stand at 60° C. for 4 hours in accordance with Japanese Industrial Standards (JIS) K 2235, being 5 mm or more.

In the above toner, the resin component may comprise a hydrogenated petroleum resin with a hydrogenation ratio of 50% or more.

It is preferable that the hydrogenated petroleum resin be in an amount of 3 to 70 wt. % of the entire weight of the resin component.

It is also preferable that the resin component further comprise a polyester resin.

DESCRIPTION OF THE PREFERRED EMBODIMENTS

The toner of the present invention comprises a resin component and has an image fixing temperature in the range of 100° to 140° C., and a penetration of 5 mm or more as measured when allowed to stand at 60° C. for 4 hours in accordance with Japanese Industrial Standards (JIS) K 2235.

It is preferable that the image fixing temperature of the toner of the present invention be in the range of 100° to 135° C., more preferably in the range of 100° to 130° C.

The above-mentioned image fixing temperature of the toner is measured when toner-images-bearing copies are made by a commercially available copying machine (Trademark "IMAGIO MF530" made by Ricoh Company, Ltd.), using the toner, in such a manner that the toner images are made on a copy paper with a toner deposition of 1.0 mg/cm$^2$, with the image fixing time period for the toner images being set at 0.028 seconds.

Furthermore, the penetration of the toner of the present invention is 5 mm or more as measured when allowed to stand at 60° C. for 4 hours in accordance with Japanese Industrial Standards (JIS) K 2235.

It is preferable that the penetration of the toner of the present invention be 10 mm or more, more preferably 15 mm. When the penetration is less than 5 mm, the thermal preservability of the toner is poor, so that the previously mentioned blocking phenomenon tends to take place.

In the toner of the present invention, the resin component may comprise a hydrogenated petroleum resin with a hydrogenation ratio of 50% or more.

The hydrogenated petroleum resin is a resin obtained by hydrogenating double bonds which remain in petroleum resin.

Petroleum resins can be synthesized from petroleum unsaturated hydrocarbons which are obtained by purifying cracked petroleum fractions which are by-products when producing ethylene, acetylene, propylene and the like by cracking naphtha.

For example, there are $C_5$ to $C_6$ aliphatic petroleum resins synthesized from $C_5$ to $C_6$ aliphatic hydrocarbons; $C_6$ to $C_8$ aromatic petroleum resins synthesized from $C_6$ to $C_8$ aromatic hydrocarbons; aliphatic—aromatic polymerized type petroleum resins; petroleum resins synthesized from dicyclopentadiene as the main starting material; and petroleum resins synthesized from higher olefin as the main starting material.

As in the present invention, by use of the hydrogenated petroleum resin as a resin component for a toner, the toner can more effectively achieve the low-temperature image fixing performance and the thermal preservability at the same time.

The single use of a hydrogenated petroleum resin in the toner as a resin component can achieve both the low-temperature image fixing performance and the thermal preservability at the same time, but the hydrogenated petroleum resin can also be employed in combination with a resin which is not good with respect to the achievement of both the low-temperature image fixing performance and the thermal preservability at the same time so long as the desired low-temperature image fixing performance and thermal preservability are attained at the same time.

The hydrogenated petroleum resin is excellent with respect to pulverizing performance, so that the hydrogenated petroleum resin can be effectively used in combination with a resin having poor pulverizing performance.

A preferable pulverizing performance is such a pulverizing performance that the toner can be pulverized at a pulverizing pressure of 3.0 to 5.0 kg/cm$^2$. The smaller the energy required for pulverizing the toner, the better. However, when the required pulverizing pressure is excessively small, large toner particles tend to be formed.

In particular, when (a) a hydrogenated petroleum resin, which is prepared from dicyclopentadiene as the main starting material, and (b) a hydrogenated petroleum resin made from $C_6$ to $C_8$ aromatic petroleum resins which are synthesized from $C_6$ to $C_8$ aromatic hydrocarbons, are used in combination, a toner with further improved thermal preservability can be obtained.

The above-mentioned petroleum resins can be hydrogenated by any of reduction methods in general use, but catalytic reduction is particularly preferable.

Specifically, such catalytic reduction is carried out by directly hydrogenating unsaturated double bonds present in the petroleum resins with hydrogen at a high temperature of 150° to 250° C. and a high pressure of 30 to 50 kg/cm$^2$ in the presence of a heavy metal catalyst such as nickel, palladium, or platinum.

The hydrogenated petroleum resin for use in the present invention has a hydrogenation ratio of 50% or more, preferably 75% or more.

When the hydrogenation ratio is less than 50%, the penetration of the toner is less than 5 mm, leading to poor thermal preservation of the toner, although the image fixing temperature of the toner is in the range of 120° C. to 150° C. and has no problems with respect to the image fixing performance.

In contrast, when the hydrogenation ratio is in the range of 50 to 75%, the image fixing temperature of the toner is in the range of 100° C. to 140° C. and the penetration thereof is in the range of 5 to 10 mm, so that the low-temperature image fixing performance and the thermal preservability are both satisfactory.

When the hydrogenation ratio is more than 75%, the image fixing temperature of the toner is in the range of 100° C. to 140° C. and the penetration thereof is more than 10 mm, so that the thermal preservability is further improved.

In the present invention, the hydrogenation ratio can be determined by determining the unsaturated double bonds present in the petroleum resin which is not yet hydrogenated.

Specifically, a halogen of iodine trichloride or iodine monobromide is caused to act on a hydrogenated petroleum resin so as to allow the double bonds present in the hydrogenated resin to react with the halogen. The amount of the halogen reacted with the double bonds is measured and then converted into an iodine value. The hydrogenation ratio of the hydrogenated petroleum resin is determined by use of a working curve which is prepared by setting the iodine value of a non-hydrogenated petroleum resin at 100%, and setting the iodine value of a completely hydrogenated petroleum resin at 0%.

It is preferable that the hydrogenated petroleum resin be in an amount of 3 to 70 wt. %, more preferable in an amount of 5 to 30 wt. %, of the entire weight of the resin component. This is because when the amount of the hydrogenated petroleum resin is less than 3 wt. %, the low-temperature image fixing performance tends to be decreased, while when the amount of the hydrogenated petroleum resin is more than 70 wt. %, the thermal preservability of the toner tends to be decreased.

It is preferable that the ring and ball softening point of the hydrogenated petroleum resin for use in the present invention be in the range of 80° to 140°, more preferably in the range of 100° to 130° C. This is because when the ring and ball softening point of the hydrogenated petroleum resin is less than 80° C., the thermal preservability of the toner tends to be impaired, although there is no problem with respect to the low-temperature image fixing performance thereof, while when the softening point is more than 140° C., the low-temperature image fixing performance tends to be impaired, although there is no problem with respect to the thermal preservability of the toner.

The ring and ball softening points of the hydrogenated petroleum resins for use in the present invention are measured in accordance with a softening point measurement method for hot-melt adhesive agents as defined in Japanese Industrial Standards (JIS) K6863-1994.

In the present invention, the above-mentioned hydrogenated resin and a conventionally known resin can be used in combination as the resin components for the toner of the present invention.

Examples of the conventionally known resin for use in the present invention are styrene resins which are homopolymers or copolymers comprising unsubstituted or substituted styrene monomer units, for example, polystyrene, chloropolystyrene, poly α-stilstyrene, styrene-chlorostyrene copolymer, styrene-propylene copolymer, styrene-butadiene copolymer, styrene-vinyl chloride copolymer, styrene-maleic acid copolymer, styrene-vinyl acetate copolymer, styrene-acrylate copolymers such as styrene-methyl acrylate copolymer, styrene-ethyl acrylate copolymer, styrene-butyl acrylate copolymer, styrene-octyl acrylate copolymer and styrene-phenyl acrylate copolymer, styrene-methacrylate copolymers such as styrene-methyl methacrylate copolymer, styrene-ethyl methacrylate copolymer, styrene-butyl methacrylate copolymer and styrene-phenyl methacrylate copolymer, styrene-methyl α-chloroacrylate copolymer and styrene-acrylonitrile-acrylic acid ester copolymer; vinyl chloride resin; rosin-modified maleic acid resin; phenolic resin; epoxy resin; polyethylene resin; polypropylene resin; ionomer resin; polyurethane resin; silicone resin; ketone resin; ethylene-ethyl acrylate copolymer; xylene resin; polyvinyl butyral resin; and polyester resin. These conventionally known resins can be used alone or in combination.

There are no particular limitations to the method of producing the above resins, but any of bulk polymerization, solution polymerization, emulsion polymerization and suspension polymerization is applicable.

Of the above resins which are to be used in combination with the hydrogenated petroleum resin for use in the present invention, polyester resin is particularly preferable.

As mentioned previously, polyester resin has the shortcoming that when polyester resin is used for producing a toner, the productivity thereof is considerably reduced in the course of a pulverizing process for the production of the toner because of the high strength of the polyester resin itself.

In the present invention, however, by use of the polyester resin in combination with the hydrogenated petroleum resin, the pulverizing performance of the polyester resin is so improved that the productivity of the toner is significantly improved. In other words, by use of the polyester resin in combination with the hydrogenated petroleum resin, a toner with excellent low-temperature image fixing performance can be produced with high productivity without causing the side effect of the polyester resin of impairing the thermal preservability.

The polyester resin for use in the present invention can be obtained by condensation polymerization of alcohol and carboxylic acid.

Specific examples of the alcohol include glycols such as ethylene glycol, diethylene glycol, triethylene glycol and propylene glycol; 1,4-bis(hydroxymethyl)cyclohexane; etherified bisphenols, for example, of, bisphenol A; other dihydric alcohol monomers; and polyhydric alcohol monomers containing three or more hydroxyl groups.

Specific examples of the carboxylic acid include organic dicarboxylic acid monomers, such as maleic acid, fumaric acid, phthalic acid, isophthalic acid, terephthalic acid, succinic acid and malonic acid; and polycarboxylic acid monomers containing three or more carboxyl groups, such as 1,2,4-benzenetricaboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane and 1,2,7,8-octanetetracarboxylic acid.

It is preferable that the Tg of the polyester resin be in the range of 65° to 75° C. When the Tg of the polyester resin is less than 65° C., the thermal preservability of the toner tends to be impaired, while when the Tg of the polyester resin is more than 75° C., the low-temperature image fixing performance of the toner tends to be impaired.

In addition to the above-mentioned resins, when necessary, a coloring agent, a charge controlling agent, a releasing agent such as wax, and a fluidity improvement agent may be contained in the toner of the present invention.

As such a coloring agent, any conventionally known pigments or dyes can be employed alone or in combination.

Specific examples of the coloring agent for use in the present invention are carbon black, lamp black, black iron oxide, aniline blue, phthalocyanine blue, phthalocyanine green, Hansa Yellow G, Rhodamine 6G Lake, Chalco Oil Blue, chrome yellow, quinacridone, Benzidine Yellow, Rose Bengale and triarylmethane dyes.

It is preferable that the amount of such a coloring agent be in the range of 1 to 30 parts by weight, more preferably in the range of 3 to 20 parts by weight, to 100 parts by weight of the resin component for the toner.

As the charge controlling agent, any conventionally known charge controlling agents such as nigrosine dye, metal complex salts, and quaternary ammonium salts, can be employed in the present invention. These charge controlling agents can be used alone or in combination.

It is preferable that the amount of such a charge controlling agent be in the range of 0.1 to 10 parts by weight, more preferably in the range of 1 to 5 parts by weight, to 100 parts by weight of the resin component for the toner.

As the releasing agent, any conventionally known releasing agents such as solid silicone varnish, higher fatty acids, higher alcohols, montan ester wax, oxidized rice wax, low-molecular-weight polypropylene wax and carnauba wax can be employed in the present invention. These releasing agents can be used alone or in combination.

It is preferable that the amount of such a releasing agent be in the range of 1 to 20 parts by weight, more preferably in the range of 3 to 10 parts by weight, to 100 parts by weight of the resin component for the toner.

As the fluidity improvement agent, any conventionally known fluidity improving agents such as silicon oxide, titanium oxide, silicon carbide, aluminum oxide and barium titanate can be employed in the present invention. These fluidity improvement agents can be used alone or in combination.

The toner of the present invention can be prepared by any of conventionally known methods. For example, a mixture of resin components such as the hydrogenated petroleum resin and polyester resin, and when necessary, a coloring agent, a charge controlling agent, and a releasing agent, is mixed in a mixer. The mixture is then melted and kneaded by a heat two-roller mixer or extruder and then cooled to prepare a solid mixture. The thus prepared solid mixture is then pulverized by a pulverizer such as a jet mill and classified, whereby a toner of the present invention is prepared. When necessary, any of the above-mentioned fluidity improvement agents is mixed with the toner in a mixer. Other features of this invention will become apparent in the course of the following description of exemplary embodiments, which are given for illustration of the invention and are not intended to be limiting thereof.

EXAMPLE 1

[Preparation of Toner No. 1]

A mixture of the following components was kneaded in an extruder:

| | Parts by Weight |
|---|---|
| Styrene - acryl copolymer (weight average molecular weight: 100,000) | 80 |
| Hydrogenated petroleum resin (softening point: 80° C., hydrogenation ratio: 50% starting materials: $C_5$ and $C_6$ aliphatic hydrocarbons) | 3 |
| Carnauba wax (melting point: 82° C.) | 5 |
| Carbon black (Trademark "#44" made by Mitsubishi Kasei Corporation) | 10 |
| Metal complex salt type dye | 2 |

The above kneaded mixture was pulverized by use of a jet pulverizer, with such a jet pulverizing pressure that provided toner particles with a volume mean diameter of 10.0 μm when the above kneaded mixture was supplied at a rate of 2.0 kg/h to the jet pulverizer, whereby toner particles were obtained.

The thus obtained toner particles were classified, whereby a toner with a volume mean diameter of 10.5 μm was obtained.

0.5 parts by weight of silicon oxide (Trademark "R-972" made by Nippon Aerosil Co., Ltd.) were mixed with 100 parts by weight of the above obtained toner in a Henschel mixer, whereby toner No. 1 of the present invention was obtained.

The toner No. 1 of the present invention was evaluated in the following manner. Results are shown in Table 1.

[Evaluation of Image Fixing Performance]

3.0 parts by weight of Toner No. 1 and 97.0 parts by weight of a silicone-coated carrier were mixed, whereby a two-component developer was prepared.

By use of this two-component developer in a commercially available electrophotographic copying machine (Trademark "IMAGIO MF530" made by Ricoh Company, Ltd.), copies were made so as to obtain toner images with an image density of 1.2 as measured by Macbeth densitometer at different image fixing temperatures for the toner images.

Toner images in the copies obtained at different image fixing temperatures were subjected to a friction test, in which a sandrubber, namely a sand or similar substance containing rubber used for erasing firmly stuck images, was attached to a clock meter and brought into contact with the toner images of each copy paper, and the toner images were rubbed 10 times to determine the image fixing ratio for each copy paper.

A minimum image fixing temperature is defined as an image fixing temperature at which an image fixing ratio of 70% is reached in accordance with the following formula:

(Image density of the toner images rubbed by the sandrubber by 10 times/Image density of the toner images not yet rubbed by the sandrubber)×100=Image Fixing Ratio (%)

[Evaluation of Thermal Preservability]

Toner No. 1 was placed in a glass container. The toner containing glass container was allowed to stand at 60° C. for 4 hours in a temperature-constant chamber. The toner was then cooled to 24° C. and subjected to a penetration test in accordance with Japanese Industrial Standards (JIS) K2235–1991.

When the penetration was 10 mm or more, the thermal preservability was evaluated as excellent, which is indicated by mark "⊙" in Table 1; when the penetration was 5 to 9.9 mm, the thermal preservability was evaluated as fairly good, which is indicated by mark "O" in Table 1; when the penetration was 3 to 4.9 mm, the thermal preservability was evaluated as insufficient for use in practice, which is indicated by mark "Δ" in Table 1; and when the penetration was 0 to 2.9 mm, the thermal preservability was evaluated as no good, which is indicated by mark "x" in Table 1.

[Evaluation of Pulverizing Performance]

When a kneaded and then cooled solid mixture was pulverized by a jet pulverizer in the course of the preparation of the toner, a pulverizing pressure at which toner particles with a volume mean diameter of 10.0 μm were obtained was determined while the supply rate of the solid mixture to be pulverized was fixed at 2.0 kg/h.

The smaller the pulverizing pressure, the easier the pulverizing and the better the toner productivity.

Comparative Example 1

A mixture of the following components was kneaded in an extruder in the same manner as in Example 1:

| | Parts by Weight |
|---|---|
| Styrene - acryl copolymer (weight average molecular weight: 100,000) | 80 |
| Non-hydrogenated petroleum resin (softening point: 80° C., hydrogenation ratio: 0% starting materials: $C_5$ and $C_6$ aliphatic hydrocarbons) | 3 |
| Carnauba wax (melting point: 82° C.) | 5 |
| Carbon black (Trademark "#44" made by Mitsubishi Kasei Corporation) | 10 |
| Metal complex salt type dye | 2 |

The above kneaded mixture was pulverized by use of a jet pulverizer, with such a jet pulverizing pressure that provided toner particles with a volume mean diameter of 10.0 μm when the above kneaded mixture was supplied at a rate of 2.0 kg/h to the jet pulverizer, whereby toner particles were obtained.

The thus obtained toner particles were classified, whereby a toner with a volume mean diameter of 10.5 μm was obtained.

0.5 parts by weight of silicon oxide (Trademark "R-972" made by Nippon Aerosil Co., Ltd.) were mixed with parts by weight of the above obtained toner in a Henschel mixer, whereby comparative toner No. 1 was obtained.

The comparative toner No. 1 was evaluated in the same manner as in Example 1. Results are shown in Table 1.

EXAMPLE 2

A mixture of the following components was kneaded in an extruder in the same manner as in Example 1:

| | Parts by Weight |
|---|---|
| Styrene - acryl copolymer (weight average molecular weight: 100,000) | 80 |
| Hydrogenated petroleum resin (softening point: 85° C., hydrogenation ratio: 70% starting materials: $C_5$ and $C_6$ aliphatic hydrocarbons) | 3 |
| Carnauba wax (melting point: 82° C.) | 5 |
| Carbon black (Trademark "#44" made by Mitsubishi Kasei Corporation) | 10 |
| Metal complex salt type dye | 2 |

The above kneaded mixture was pulverized by use of a jet pulverizer, with such a jet pulverizing pressure that provided toner particles with a volume mean diameter of 10.0 μm when the above kneaded mixture was supplied at a rate of 2.0 kg/h to the jet pulverizer, whereby toner particles were obtained.

The thus obtained toner particles were classified, whereby a toner with a volume mean diameter of 10.5 μm was obtained.

0.5 parts by weight of silicon oxide (Trademark "R-972" made by Nippon Aerosil Co., Ltd.) were mixed with parts by weight of the above obtained toner in a Henschel mixer, whereby toner No. 2 of the present invention was obtained.

The toner No. 2 of the present invention was evaluated in the same manner as in Example 1. Results are shown in Table 1.

EXAMPLE 3

A mixture of the following components was kneaded in an extruder in the same manner as in Example 1:

| | Parts by Weight |
|---|---|
| Styrene - acryl copolymer (weight average molecular weight: 80,000) | 28 |
| Hydrogenated petroleum resin (softening point: 150° C., hydrogenation ratio: 95% starting materials: $C_5$ and $C_6$ aliphatic hydrocarbons) | 55 |
| Carnauba wax (melting point: 82° C.) | 5 |
| Carbon black (Trademark "#44" made by Mitsubishi Kasei Corporation) | 10 |
| Metal complex salt type dye | 2 |

The above kneaded mixture was pulverized by use of a jet pulverizer, with such a jet pulverizing pressure that provided toner particles with a volume mean diameter of 10.0 μm when the above kneaded mixture was supplied at a rate of 2.0 kg/h to the jet pulverizer, whereby toner particles were obtained.

The thus obtained toner particles were classified, whereby a toner with a volume mean diameter of 10.5 μm was obtained.

0.5 parts by weight of silicon oxide (Trademark "R-972" made by Nippon Aerosil Co., Ltd.) were mixed with parts by weight of the above obtained toner in a Henschel mixer, whereby toner No. 3 of the present invention was obtained.

The toner No. 3 of the present invention was evaluated in the same manner as in Example 1. Results are shown in Table 1.

EXAMPLE 4

A mixture of the following components was kneaded in an extruder in the same manner as in Example 1:

| | Parts by Weight |
|---|---|
| Styrene - acryl copolymer (weight average molecular weight: 100,000) | 79 |
| Hydrogenated petroleum resin (softening point: 80° C., hydrogenation ratio: 95% starting materials: dicyclo-pentadiene + aromatic hydrocarbons) | 4 |
| Carnauba wax (melting point: 82° C.) | 5 |
| Carbon black (Trademark "#44" made by Mitsubishi Kasei Corporation) | 10 |
| Metal complex salt type dye | 2 |

The above kneaded mixture was pulverized by use of a jet pulverizer, with such a jet pulverizing pressure that provided toner particles with a volume mean diameter of 10.0 μm when the above kneaded mixture was supplied at a rate of 2.0 kg/h to the jet pulverizer, whereby toner particles were obtained.

The thus obtained toner particles were classified, whereby a toner with a volume mean diameter of 10.5 μm was obtained.

0.5 parts by weight of silicon oxide (Trademark "R-972" made by Nippon Aerosil Co., Ltd.) were mixed with parts by weight of the above obtained toner in a Henschel mixer, whereby toner No. 4 of the present invention was obtained.

The toner No. 4 of the present invention was evaluated in the same manner as in Example 1. Results are shown in Table 1.

EXAMPLE 5

A mixture of the following components was kneaded in an extruder in the same manner as in Example 1:

| | Parts by Weight |
|---|---|
| Styrene - acryl copolymer (weight average molecular weight: 100,000) | 79 |
| Hydrogenated petroleum resin (softening point: 100° C., hydrogenation ratio: 95% starting materials: dicyclo-pentadiene + aromatic hydrocarbons) | 4 |
| Carnauba wax (melting point: 82° C.) | 5 |
| Carbon black (Trademark "#44" made by Mitsubishi Kasei Corporation) | 10 |
| Metal complex salt type dye | 2 |

The above kneaded mixture was pulverized by use of a jet pulverizer, with such a jet pulverizing pressure that provided toner particles with a volume mean diameter of 10.0 μm when the above kneaded mixture was supplied at a rate of 2.0 kg/h to the jet pulverizer, whereby toner particles were obtained.

The thus obtained toner particles were classified, whereby a toner with a volume mean diameter of 10.5 μm was obtained.

0.5 parts by weight of silicon oxide (Trademark "R-972" made by Nippon Aerosil Co., Ltd.) were mixed with parts by weight of the above obtained toner in a Henschel mixer, whereby toner No. 5 of the present invention was obtained.

The toner No. 5 of the present invention was evaluated in the same manner as in Example 1. Results are shown in Table 1.

EXAMPLE 6

A mixture of the following components was kneaded in an extruder in the same manner as in Example 1:

| | Parts by Weight |
|---|---|
| Styrene - acryl copolymer (weight average molecular weight: 100,000) | 33 |
| Hydrogenated petroleum resin (softening point: 140° C., hydrogenation ratio: 95% starting materials: dicyclo-pentadiene + aromatic hydrocarbons) | 50 |
| Carnauba wax (melting point: 82° C.) | 5 |
| Carbon black (Trademark "#44" made by Mitsubishi Kasei Corporation) | 10 |
| Metal complex salt type dye | 2 |

The above kneaded mixture was pulverized by use of a jet pulverizer, with such a jet pulverizing pressure that provided toner particles with a volume mean diameter of 10.0 μm when the above kneaded mixture was supplied at a rate of 2.0 kg/h to the jet pulverizer, whereby toner particles were obtained.

The thus obtained toner particles were classified, whereby a toner with a volume mean diameter of 10.5 μm was obtained.

0.5 parts by weight of silicon oxide (Trademark "R-972" made by Nippon Aerosil Co., Ltd.) were mixed with 100 parts by weight of the above obtained toner in a Henschel mixer, whereby toner No. 6 of the present invention was obtained.

The toner No. 6 of the present invention was evaluated in the same manner as in Example 1. Results are shown in Table 1.

EXAMPLE 7

A mixture of the following components was kneaded in an extruder in the same manner as in Example 1:

| | Parts by Weight |
|---|---|
| Styrene - acryl copolymer (weight average molecular weight: 100,000) | 73 |
| Hydrogenated petroleum resin (softening point: 110° C., hydrogenation ratio: 95% | 10 |

-continued

| | Parts by Weight |
|---|---|
| starting materials: dicyclo-pentadiene + aromatic hydrocarbons) | |
| Carnauba wax (melting point: 82° C.) | 5 |
| Carbon black (Trademark "#44" made by Mitsubishi Kasei Corporation) | 10 |
| Metal complex salt type dye | 2 |

The above kneaded mixture was pulverized by use of a jet pulverizer, with such a jet pulverizing pressure that provided toner particles with a volume mean diameter of 10.0 μm when the above kneaded mixture was supplied at a rate of 2.0 kg/h to the jet pulverizer, whereby toner particles were obtained.

The thus obtained toner particles were classified, whereby a toner with a volume mean diameter of 10.5 μm was obtained.

0.5 parts by weight of silicon oxide (Trademark "R-972" made by Nippon Aerosil Co., Ltd.) were mixed with parts by weight of the above obtained toner in a Henschel mixer, whereby toner No. 7 of the present invention was obtained.

The toner No. 7 of the present invention was evaluated in the same manner as in Example 1. Results are shown in Table 1.

EXAMPLE 8

A mixture of the following components was kneaded in an extruder in the same manner as in Example 1:

| | Parts by Weight |
|---|---|
| Styrene - acryl copolymer (weight average molecular weight: 100,000) | 43 |
| Hydrogenated petroleum resin (softening point: 100° C., hydrogenation ratio: 95% starting materials: dicyclo-pentadiene + aromatic hydrocarbons) | 40 |
| Carnauba wax (melting point: 82° C.) | 5 |
| Carbon black (Trademark "#44" made by Mitsubishi Kasei Corporation) | 10 |
| Metal complex salt type dye | 2 |

The above kneaded mixture was pulverized by use of a jet pulverizer, with such a jet pulverizing pressure that provided toner particles with a volume mean diameter of 10.0 μm when the above kneaded mixture was supplied at a rate of 2.0 kg/h to the jet pulverizer, whereby toner particles were obtained.

The thus obtained toner particles were classified, whereby a toner with a volume mean diameter of 10.5 μm was obtained.

0.5 parts by weight of silicon oxide (Trademark "R-972" made by Nippon Aerosil Co., Ltd.) were mixed with 100 parts by weight of the above obtained toner in a Henschel mixer, whereby toner No. 8 of the present invention was obtained.

The toner No. 8 of the present invention was evaluated in the same manner as in Example 1. Results are shown in Table 1.

EXAMPLE 9

A mixture of the following components was kneaded in an extruder in the same manner as in Example 1:

| | Parts by Weight |
|---|---|
| Polyester resin (softening point: 100° C., acid value: 5.0) | 63 |
| Hydrogenated petroleum resin (softening point: 100° C., hydrogenation ratio: 95% starting materials: dicyclopentadiene + aromatic hydrocarbons) | 20 |
| Carnauba wax (melting point: 82° C.) | 5 |
| Carbon black (Trademark "#44" made by Mitsubishi Kasei Corporation) | 10 |
| Metal complex salt type dye | 2 |

The above kneaded mixture was pulverized by use of a jet pulverizer, with such a jet pulverizing pressure that provided toner particles with a volume mean diameter of 10.0 μm when the above kneaded mixture was supplied at a rate of 2.0 kg/h to the jet pulverizer, whereby toner particles were obtained.

The thus obtained toner particles were classified, whereby a toner with a volume mean diameter of 10.5 μm was obtained.

0.5 parts by weight of silicon oxide (Trademark "R-972" made by Nippon Aerosil Co., Ltd.) were mixed with 100 parts by weight of the above obtained toner in a Henschel mixer, whereby toner No. 9 of the present invention was obtained.

The toner No. 9 of the present invention was evaluated in the same manner as in Example 1. Results are shown in Table 1.

EXAMPLE 10

A mixture of the following components was kneaded in an extruder in the same manner as in Example 1:

| | Parts by Weight |
|---|---|
| Polyester resin (softening point: 100° C., acid value: 3.0) | 73 |
| Hydrogenated petroleum resin (softening point: 95° C., hydrogenation ratio: 60% starting materials: dicyclopentadiene + aromatic hydrocarbons) | 10 |
| Carnauba wax (melting point: 82° C.) | 5 |
| Carbon black (Trademark "#44" made by Mitsubishi Kasei Corporation) | 10 |
| Metal complex salt type dye | 2 |

The above kneaded mixture was pulverized by use of a jet pulverizer, with such a jet pulverizing pressure that provided toner particles with a volume mean diameter of 10.0 μm when the above kneaded mixture was supplied at a rate of 2.0 kg/h to the jet pulverizer, whereby toner particles were obtained.

The thus obtained toner particles were classified, whereby a toner with a volume mean diameter of 10.5 μm was obtained.

0.5 parts by weight of silicon oxide (Trademark "R-972" made by Nippon Aerosil Co., Ltd.) were mixed with 100 parts by weight of the above obtained toner in a Henschel mixer, whereby toner No. 10 of the present invention was obtained.

The toner No. 10 of the present invention was evaluated in the same manner as in Example 1. Results are shown in Table 1.

Comparative Example 2

A mixture of the following components was kneaded in an extruder in the same manner as in Example 1:

| | Parts by Weight |
|---|---|
| Polyester resin (softening point: 100° C., acid value: 5.0) | 63 |
| Non-hydrogenated petroleum resin (softening point: 100° C., hydrogenation ratio: 0% starting materials: dicyclopentadiene + aromatic hydrocarbons) | 20 |
| Carnauba wax (melting point: 82° C.) | 5 |
| Carbon black (Trademark "#44" made by Mitsubishi Kasei Corporation) | 10 |
| Metal complex salt type dye | 2 |

The above kneaded mixture was pulverized by use of a jet pulverizer, with such a jet pulverizing pressure that provided toner particles with a volume mean diameter of 10.0 μm when the above kneaded mixture was supplied at a rate of 2.0 kg/h to the jet pulverizer, whereby toner particles were obtained.

The thus obtained toner particles were classified, whereby a toner with a volume mean diameter of 10.5 μm was obtained.

0.5 parts by weight of silicon oxide (Trademark "R-972" made by Nippon Aerosil Co., Ltd.) were mixed with parts by weight of the above obtained toner in a Henschel mixer, whereby comparative toner No. 2 was obtained.

The comparative toner No. 2 was evaluated in the same manner as in Example 1. Results are shown in Table 1.

Comparative Example 3

A mixture of the following components was kneaded in an extruder in the same manner as in Example 1:

| | Parts by Weight |
|---|---|
| Polyester resin (softening point: 100° C., acid value: 5.0) | 73 |
| Hydrogenated petroleum resin (softening point: 95° C., hydrogenation ratio: 30% starting materials: dicyclopentadiene + aromatic hydrocarbons) | 10 |
| Carnauba wax (melting point: 82° C.) | 5 |
| Carbon black (Trademark "#44" made by Mitsubishi Kasei Corporation) | 10 |
| Metal complex salt type dye | 2 |

The above kneaded mixture was pulverized by use of a jet pulverizer, with such a jet pulverizing pressure that provided toner particles with a volume mean diameter of 10.0 μm when the above kneaded mixture was supplied at a rate of 2.0 kg/h to the jet pulverizer, whereby toner particles were obtained.

The thus obtained toner particles were classified, whereby a toner with a volume mean diameter of 10.5 μm was obtained.

0.5 parts by weight of silicon oxide (Trademark "R-972" made by Nippon Aerosil Co., Ltd.) were mixed with parts by weight of the above obtained toner in a Henschel mixer, whereby comparative toner No. 3 was obtained.

The comparative toner No. 3 was evaluated in the same manner as in Example 1. Results are shown in Table 1.

Comparative Example 4

A mixture of the following components was kneaded in an extruder in the same manner as in Example 1:

| | Parts by Weight |
|---|---|
| Polyester resin (softening point: 100° C., acid value: 5.0) | 83 |
| Carnauba wax (melting point: 82° C.) | 5 |
| Carbon black (Trademark "#44" made by Mitsubishi Kasei Corporation) | 10 |
| Metal complex salt type dye | 2 |

The above kneaded mixture was pulverized by use of a jet pulverizer, with such a jet pulverizing pressure that provided toner particles with a volume mean diameter of 10.0 μm when the above kneaded mixture was supplied at a rate of 2.0 kg/h to the jet pulverizer, whereby toner particles were obtained.

The thus obtained toner particles were classified, whereby a toner with a volume mean diameter of 10.5 μm was obtained.

0.5 parts by weight of silicon oxide (Trademark "R-972" made by Nippon Aerosil Co., Ltd.) were mixed with 100 parts by weight of the above obtained toner in a Henschel mixer, whereby comparative toner No. 4 was obtained.

The comparative toner No. 4 was evaluated in the same manner as in Example 1. Results are shown in the following Table 1:

TABLE 1

| | Lower limit image fixing temp. (°C.) | Thermal Preservation | Penetration (mm) | Pulverizing force (kg/cm$^2$) |
|---|---|---|---|---|
| Ex. 1 | 135 | ○ | 8 | 5.0 |
| Comp. Ex. 1 | 135 | x | 1 | 5.5 |
| Ex. 2 | 135 | ○ | 9 | 5.0 |
| Ex. 3 | 130 | ◎ | 15 | 5.3 |
| Ex. 4 | 125 | ◎ | 19 | 4.5 |
| Ex. 5 | 125 | ◎ | 21 | 4.5 |
| Ex. 6 | 120 | ◎ | 23 | 4.7 |
| Ex. 7 | 120 | ◎ | 25 | 4.0 |
| Ex. 8 | 115 | ◎ | 24 | 3.7 |
| Ex. 9 | 110 | ◎ | 25 | 3.2 |
| Comp. Ex. 2 | 115 | x | 2 | 3.4 |
| Ex. 10 | 110 | ○ | 8 | 4.0 |
| Comp. Ex. 3 | 110 | Δ | 4 | 4.1 |
| Comp. Ex. 4 | 135 | ○ | 7 | 6.0 |

Japanese Patent Application No. 7-020732 filed Feb. 8, 1995, and Japanese Patent Application 8-008774 filed Jan. 22, 1996 are hereby incorporated by reference.

What is claimed is:

1. A toner for developing latent electrostatic images comprising a hydrogenated petroleum resin component, with the image fixing temperature of said toner being in the range of 100° C. to 140° C., and the penetration of said toner, measured when allowed to stand at 60° C. for 4 hours in accordance with Japanese Industrial Standards (JIS) K 2235, being 5 mm or more.

2. The toner as claimed in claim 1, wherein said resin component comprises a hydrogenated petroleum resin with a hydrogenation ratio of 50% or more.

3. The toner as claimed in claim 2, wherein the amount of said hydrogenated petroleum resin is in an amount of 3 to 70 wt. % of the entire weight of said resin component.

4. The toner as claimed in claim 2, wherein said resin component further comprises a polyester resin.

* * * * *

UNITED STATES PATENT AND TRADEMARK OFFICE

CERTIFICATE OF CORRECTION

PATENT NO. : 5,614,347
DATED : MARCH 25, 1997
INVENTOR(S) : MITSUO AOKI, ET AL

It is certified that error appears in the above-identified patent and that said Letters Patent is hereby corrected as shown below:

Column 8, line 61, "mixed with parts" should read --mixed with 100 parts--.

Column 9, line 31, "mixed with parts" should read --mixed with 100 parts--.

Column 10, line 2, "mixed with parts" should read --mixed with 100 parts--.

Column 10, line 40, "mixed with parts" should read --mixed with 100 parts--.

Column 11, line 11, "mixed with parts" should read --mixed with 100 parts--.

Column 12, line 23, "mixed with parts" should read --mixed with 100 parts--.

UNITED STATES PATENT AND TRADEMARK OFFICE

CERTIFICATE OF CORRECTION

PATENT NO. : 5,614,347

DATED : MARCH 25, 1997

INVENTOR(S) : MITSUO AOKI, ET AL

It is certified that error appears in the above-identified patent and that said Letters Patent is hereby corrected as shown below:

Column 14, line 41, "mixed with parts" should read --mixed with 100 parts--.

Column 15, line 11, "mixed with parts" should read --mixed with 100 parts--.

Signed and Sealed this

Twenty-first Day of July, 1998

Bruce Lehman

*Attest:*

BRUCE LEHMAN

*Attesting Officer*

*Commissioner of Patents and Trademarks*